United States Patent [19]

Johnson et al.

[11] Patent Number: 4,830,274

[45] Date of Patent: May 16, 1989

[54] PRESSURE INDEPENDENT VAV VALVE WITH PRESSURE DEPENDENT BACKUP

[75] Inventors: Tedd P. Johnson, La Crosse, Wis.; Ronald J. Lievens, York, Pa.

[73] Assignee: American Standard Inc., New York, N.Y.

[21] Appl. No.: 268,743

[22] Filed: Nov. 8, 1988

Related U.S. Application Data

[63] Continuation of Ser. No. 136,889, Dec. 22, 1987.

[51] Int. Cl.[4] ..... F24F 7/00; F25B 29/00

[52] U.S. Cl. ..... 236/1 B; 236/49.5; 236/94

[58] Field of Search ..... 62/126, 127, 129, 131; 165/11.1, 16; 236/49 R, 49 D, 11, 94, 1 B

[56] References Cited

U.S. PATENT DOCUMENTS

| | | | |
|---|---|---|---|
| 4,291,832 | 9/1981 | Ginn et al. | 236/49 |
| 4,406,397 | 9/1983 | Kamata et al. | 236/1 B |
| 4,432,210 | 2/1984 | Saito | 62/126 |
| 4,653,280 | 3/1987 | Hansen et al. | 62/127 |
| 4,716,957 | 1/1988 | Thompson et al. | 236/1 B |

*Primary Examiner*—Harry B. Tanner

*Attorney, Agent, or Firm*—William J. Beres; Daivd L. Polsley; Robert J. Harter

[57] ABSTRACT

A pressure independent variable air volume valve (VAV valve) functions as a pressure dependent valve upon detecting a malfunctioning airflow indicator. Under normal operating conditions, the VAV valve modulates supply airflow to a comfort zone in response to the zone temperature and the rate of airflow through the valve. If the airflow indicator fails, the VAV valve modulates the supply airflow in response to the zone temperature, independent of the airflow indicator.

15 Claims, 2 Drawing Sheets

PRESSURE INDEPENDENT VAV VALVE WITH PRESSURE DEPENDENT BACKUP

This is a continuation of application Ser. No. 136,889, filed Dec. 22, 1987, pending.

TECHNICAL FIELD

The subject invention generally pertains to airflow regulators that modulate a supply airflow to a comfort zone, and more specifically pertains to airflow regulators that are responsive to both temperature and upstream air pressure.

BACKGROUND OF THE INVENTION

The temperature of a comfort zone, such as a room within a building, can be controlled by regulating the amount of temperature conditioned air supplied to the zone. Airflow regulators used for this purpose are mounted to a supply air duct and are generally referred to as variable air volume valves, or simply VAV valves.

Airflow through VAV valves is often controlled by varying the valve opening in response to the temperature of the zone. Valves under such control are referred to as pressure dependent valves, because for a given valve opening, the amount of airflow depends on the air pressure upstream of the valve. In some systems, airflow regulation becomes inadequate as a result of widely varying upstream pressure due to varying supply air blower speed or the effects of the opening and closing of other VAV valves in the system.

An improvement in airflow regulation is provided by controlling VAV valves in response to upstream pressure in addition to zone temperature. Such valves are referred to as pressure independent valves. Should the upstream pressure vary for any reason, the pressure independent valve will compensate by opening or closing an appropriate amount to maintain the desired airflow.

Pressure independent valves are generally superior to pressure dependent valves, provided an airflow indicator associated with the pressure independent valve doesn't fail. Should failure occur, present VAV valves typically lock at a fixed position. Depending on the specific control, the valve may lock fully open, fully closed, or at some other intermediate position. Regardless of the position, the failure of a pressure transducer associated with the airflow indicator destroys the valves ability to modulate flow.

Therefore, it is an object of the invention to provide a VAV valve that modulates airflow in response to temperature and upstream pressure, and continues to modulate airflow even when a pressure transducer associated with the valve fails.

Another object of the invention is to provide a VAV valve with a control that avoids the flow regulating problems associated with pressure dependent valves.

A further object is to reduce a VAV valve's dependence on a flow indicator incorporating a pressure transducer.

A still further object is to provide a VAV valve that properly modulates airflow as it compensates for varying speeds of an upstream supply air blower and compensates for the opening and closing of other VAV valves.

Another object is to detect a faulty pressure transducer by determining the valve position and comparing a signal provided by the transducer to a predetermined normal range for the given valve position.

Yet another object is to determine an intermediate valve position between fully open and fully closed without actually sensing an intermediate position of the valve.

These and other objects of the invention will a apparent from the attached drawings and the description of the preferred embodiment that follows below.

SUMMARY OF THE INVENTION

A normally pressure independent VAV valve functions as a pressure dependent valve upon failure of a flow indicator associated with the valve.

DESCRIPTION OF THE PREFERRED EMBODIMENT

Figure 1:
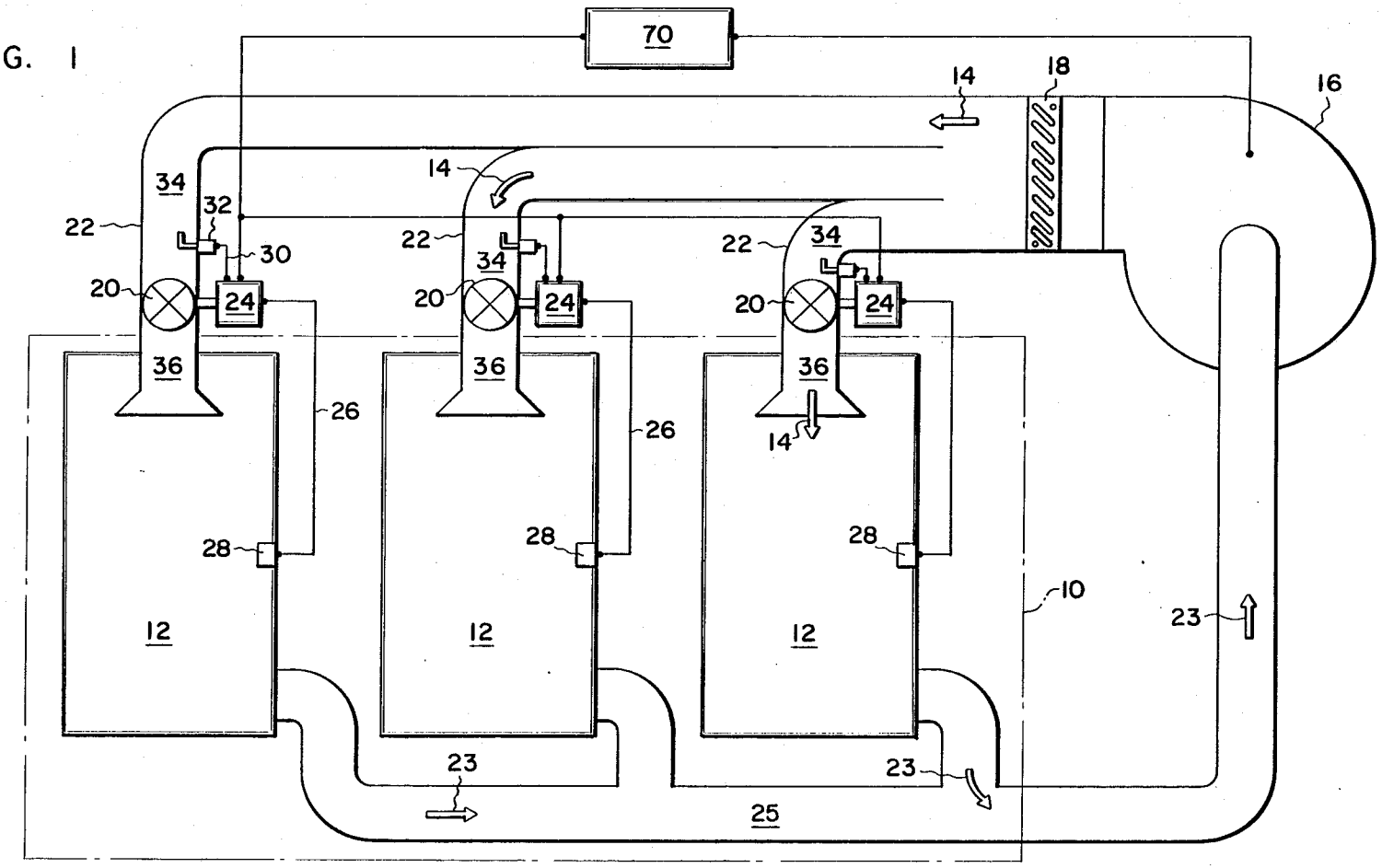
FIG. 1 illustrates a VAV system incorporating a preferred embodiment of the invention.

FIG. 1 shows a building 10 having three comfort zones 12 whose temperature is controlled by a VAV system incorporating the subject invention. Supply air 14 discharged by a variable speed blower 16 is temperature conditioned by a heat exchanger 18 before being distributed to zones 12. In the preferred embodiment, heat exchanger 18 is a refrigeration cooling coil (evaporator). However in a broader sense, heat exchanger 18 represents any device for heating or cooling air such as a steam coil, electric heater, combustion gas to air heat exchanger, and refrigeration coils, i.e., condensers and evaporators. A VAV valve 20 disposed in a supply air duct 22 leading to each zone 12 regulates the airflow to its respective zone 12 to meet each zone's temperature conditioning demand. Return air 23 is conveyed back to blower 16 via a return air duct 25.

The opening and closing of each valve 20 is controlled by separate valve controllers 24. Each valve controller 24 determines a desired supply airflow rate based on a control signal 26 provided by a thermostat 28. The deisred airflow rate is that which will meet the temperature conditioning demand of the zone. Thermostat 28 represents any temperature sensor that provides a control signal 26 that changes in response to a temperature associated with at least one zone 12.

Each valve controller 24 also determines the actual airflow rate based on a feedback signal 30 provided by a flow indicator 32. Flow indicator 32 represents any device which provides a feedback signal 30 that changes in response to a physical parameter of supply air 14. Examples of the physical parameter include, but are not limited to, the rate of airflow, total pressure, static pressure, and velocity pressure. The specific flow indicator 32 used in the preferred embodiment functions under the same operating principles as a Pitot tube; however, a wide variety of other flow indicators could also be used. For example, the rate of airflow could be determined as a function of valve position in conjunction with static or total pressure readings taken both upstream 34 and downstream 36 of valve 20. As another example, in certain installations, one could assume a predetermined downstream pressure and determine airflow as a function of valve position and upstream pressure alone. Airflow can also be measured using a variety of other flow indicators such as flow turbines, orifices, venturies, vortex sensors, and electric heat dissipators.

Based on the feedback signal 30 respresenting the actual airflow rate, and based on the thermostat's control signal 26 from which a desired airflow is derived, controller 24 determines the appropriate valve position and moves valve 20 accordingly. Should flow indicator 32 malfunction, valve controller 24 disregards erroneous feedback signals and varies the valve position in response to the temperature error. In effect, the normally pressure independent valve 20 functions as a pressure dependent valve in the event of a flow indicator failure. A means for detecting a flow indicator failure is incorporated in the valve controller's control algorithm shown in FIG. 2.

Figure 2:
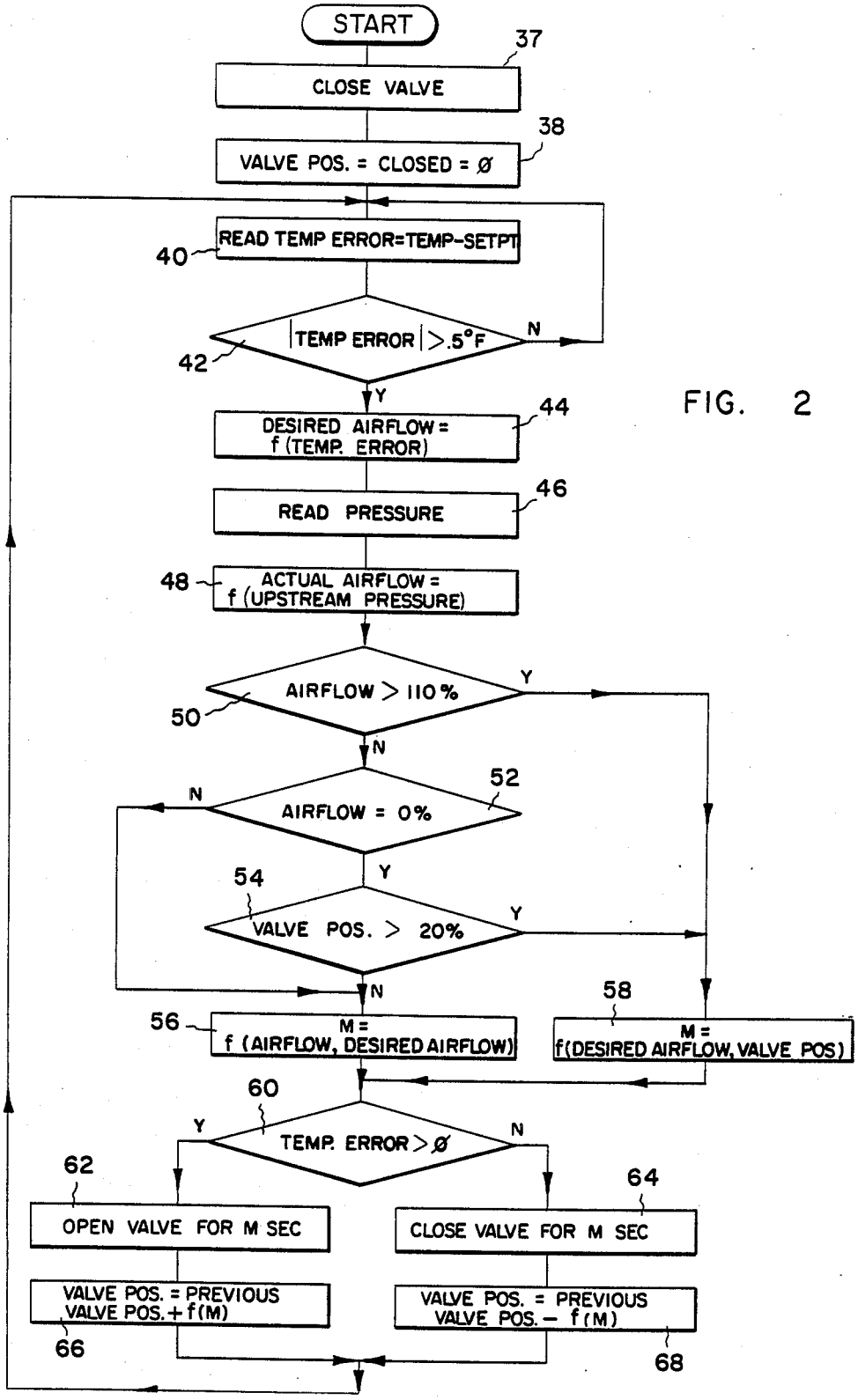
FIG. 2 shows the control algorithm of the VAV valve controller.

Referring to FIG. 2, control begins at blocks 37 and 38 by initially driving the valve to the closed position. In block 40, controller 24 determines the temperature error by comparing the actual temperature of the zone sensed by thermostat 28 to a setpoint temperature of the zone. If the error is within a deadband, e.g., 0.5° F., no control action is taken as indicated by decision block 42. Otherwise, block 44 determines a desired airflow rate as a function of the temperature error. Depending on the desired degree of control, the function can be proportional, integral, proportional plus integral, or any one of the many widely used control schemes.

Blocks 46 and 48 direct controller 24 to read the electrical feedback signal 30 provided by flow indicator 32, and compute the actual airflow as a predetermined function of signal 30.

Decision blocks 50, 52, and 54 provide means for detecting a flow indicator failure. A flow indicator failure is identified if the computed actual airflow rate is greater than a predetermined limit, e.g., 110% of a nominal value representing a maximum possible airflow rate. An indicator failure is also identified as a computed airflow rate of zero for a given valve position, e.g., 20% open. If an airflow indicator failure exists, block 58 computes a desired change in valve position as a predetermined function of desired airflow (block 44) and the valve position. If no failure exists, the change in valve position is computed by block 56 as a function of airflow (block 48) and desired airflow (block 44).

Decision block 60 determines whether valve 20 should be driven open or closed for the time increment "M" computed in blocks 56 and 58, and block 62 or 64 directs controller 24 to move valve 20 accordingly. The change in valve position "M" is in terms of time to eliminate the need for intermediate valve position sensors. Controller 24 is programmed to know the time it takes to move valve 20 between fully open and fully closed. The time period is 10 seconds in one embodiment of the invention. With this information, controller 24 controls and monitors the position of valve 20 based on the time increment that valve 20 is driven open or closed.For example, if the current position of valve 20 is 50% open and valve 20 is driven closed for 2 seconds, the new valve position will be 30% open. This new valve position is subsequently relied upon as the current valve position in blocks 54 and 58. The algorithm continually repeats as long as the VAV system is operating or an interrupt momentarily stops the algorithm to allow for valve position calibration.

In the preferred embodiment of the invention, the algorithm is carried out by means of an NEC 78C10 microcomputer. The microcomputer based control lends itself well to be externally controlled by a central controller 70. Controller 70 provides a convenient means for remotely monitoring and altering the acutal control of valves 20 and blower 16 to respond to accupancy, diurnal changes or varying temperature setpoints.

Although the invention is described with respect to a preferred embodiment, modifications thereto will be apparent to those skilled in the art. Therefore, the scope of the invention is to be determined by reference to the claims which follow.

We claim:

1. An airflow regulator comprising:

(a) a valve adapted to connect to a supply air duct that conveys temperature conditioned air to a comfort zone, said valve having a valve position that varies to modulate airflow passing from an upstream to a downstream side of said valve;

(b) means for receiving a control signal that changes in response to a temperature associated with said zone;

(c) a flow indicator for providing a feedback signal that represents the flow rate of said air;

(d) means for determining said valve position;

(e) means for detecting a flow indicator failure; and (f) means for modulating said valve position in response to said control signal and said feedback signal in an absence of said flow indicator failure, and for modulating said valve position in response to said control signal and said valve position, independent of said feedback signal, upon detecting said flow indicator failure.

2. The airflow regulator as recited in claim 1, wherein said flow indicator failure is identified as said feedback signal reaching a predetermined limit.

3. The airflow regulator as recited in claim 1, wherein said flow indicator failure is identified as said feedback signal reaching a predetermined limit for a given valve position.

4. The airflow regulator as recited in claim 1, wherein said means for determining said valve position includes measuring the time it takes said valve to vary from one valve position to another.

5. A variable air volume system comprising:

(a) a variable speed blower for discharging supply air;

(b) a heat exchanger connect in series flow relationship with said blower;

(c) a plurality of valves connected in parallel flow relationship with each other and connected in series flow relationship with said blower and said heat exchanger, each of said valves being connected to convey said supply air to a corresponding plurality of comfort zones, and each of said valves having a variable valve position to regulate the flow rate of said supply air;

(d) a plurality of thermostats, each being associated with a corresponding comfort zone for providing a control signal that changes in response to a temperature associated with said thermostat's corresponding zone;

(e) a plurality of flow indicators, each being associated with a corresponding valve for providing a feedback signal that changes in response to a change in airflow of supply air through said flow indicator's corresponding valve;

(f) means for determining said valve position;

(g) means for detecting a flow indicator failure;

(h) a plurality of valve controllers driving said plurality of valves between an open and closed position to modulate the airflow of said supply air through each of said valves in response to said control signal and said feedback signal in an absence of said flow indicator failure and in response to said control signal and said valve position, independent of said feedback signal, upon detecting said flow indicator failure; and (i) a central controller electrically connected to said blower and said valve controllers for adjusting the speed of said blower and for altering the control of said valves.

6. The variable air volume system as recited in claim 5, wherein said flow indicator failure is identified as one of said feedback signals reaching a predetermined limit.

7. The variable air volume system as recited in claim 5, wherein said flow indicators sense air pressure at an upstream side of each of said valves.

8. The variable air volume system as recited in claim 5, wherein said flow indicator failure is identified as one of said feedback signals reaching a predetermined limit for a given valve position.

9. The variable air volume system as recited in claim 5, wherein said means for determining said valve position includes means for measuring the time it takes said valve to vary from one valve position to another.

10. A method of controlling a VAV valve having a variable opening comprising the steps of:

sensing a temperature associated with a comfort zone;

sensing a rate of airflow through said valve by using a flow indicator;

detecting, should it occur, a flow indicator failure;

determining the extent of said opening; and varying said variable opening in response to said temperature and said rate of airflow in the absence of said flow indicator failure, and varying said variable opening in response to said temperature and said opening, independent of said rate of airflow, upon detecting a flow indicator failure.

11. The method of controlling a VAV valve as recited in claim 10, wherein said flow indicator failure is identified as said rate of airflow reaching a predetermined limit.

12. The method of controlling a VAV valve as recited in claim 10, wherein the step of sensing said rate of airflow involves sensing air pressure upstream of said valve.

13. The method of controlling a VAV valve as recited in claim 10, further comprising the step of determining the extent of said variable opening, and wherein said flow indicator failure is identified as said rate of airflow reaching a predetermined limit for a given extent of opening.

14. The method of controlling a VAV valve as recited in claim 13, wherein the step of determining the extent of said variable opening involves measuring the time it takes said opening to change from one extent to another.

15. The method of controlling a VAV valve as recited in claim 10, further comprising the step of varying the speed of a blower disposed upstream of said valve.

* * * * *